US011715633B2

(12) United States Patent
Cooks et al.

(10) Patent No.: US 11,715,633 B2
(45) **Date of Patent: *Aug. 1, 2023**

(54) MULTIPLEXED INDUCTIVE IONIZATION SYSTEMS AND METHODS

(71) Applicant: Purdue Research Foundation, West Lafayette, IN (US)

(72) Inventors: Robert Graham Cooks, West Lafayette, IN (US); Zhenwei Wei, West Lafayette, IN (US); David G. McLaren, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/464,135

(22) Filed: Sep. 1, 2021

(65) Prior Publication Data

US 2022/0028676 A1 Jan. 27, 2022

Related U.S. Application Data

(63) Continuation of application No. 16/885,540, filed on May 28, 2020, now Pat. No. 11,139,157.
(Continued)

(51) Int. Cl.
*H01J 49/16* (2006.01)
*H01J 49/04* (2006.01)

(52) U.S. Cl.
CPC ..... *H01J 49/167* (2013.01); *H01J 49/0409* (2013.01); *H01J 49/0431* (2013.01)

(58) Field of Classification Search
CPC .... H01J 49/0409; H01J 49/431; H01J 49/165; H01J 49/167; H01J 27/02; H01J 27/022; G01N 27/62
See application file for complete search history.

(56) References Cited

U.S. PATENT DOCUMENTS 5,644,131 A 7/1997 Hansen
6,191,418 B1 * 2/2001 Hindsgaul ..... H01J 49/165 250/288

(Continued)

FOREIGN PATENT DOCUMENTS

WO 0041214 A1 7/2000
WO 2009/023361 A2 2/2009

OTHER PUBLICATIONS

Bonner, 1977, The Cylindrical Ion Trap, International Journal of Mass Spectrometry and Ion Physics, 24(3):255-269.

(Continued)

*Primary Examiner* — David E Smith
(74) *Attorney, Agent, or Firm* — Brown Rudnick LLP; Adam M. Schoen

(57) ABSTRACT

The invention generally relates to systems including nano-electrospray ionization emitters in a movable array format in which the emitters can be loaded, singly or simultaneously, through their narrow ends using a novel dip and go method based on capillary action, taking up sample from an array. The sample solutions in each emitter can be electrophoretically cleaned, singly or simultaneously, by creating an inductive electric field that moves interfering ions away from the narrow end of the capillary. Subsequent to cleaning, the emitters are supplied with an inductive electric field that causes electrospray into a mass spectrometer allowing mass analysis of the contents of the emitter.

7 Claims, 14 Drawing Sheets

Related U.S. Application Data

(60) Provisional application No. 62/855,090, filed on May 31, 2019.

(56) References Cited

U.S. PATENT DOCUMENTS

| | | | | |
|---|---|---|---|---|
| 6,207,954 | B1 * | 3/2001 | Andrien, Jr. | H01J 49/107 250/288 |
| 6,838,666 | B2 | 1/2005 | Ouyang et al. | |
| 7,214,320 | B1 * | 5/2007 | Gregori | H01J 49/0463 210/198.2 |
| 7,816,645 | B2 * | 10/2010 | Kelly | H01J 49/167 250/281 |
| 8,304,718 | B2 | 11/2012 | Ouyang et al. | |
| 9,184,036 | B2 | 11/2015 | Cooks et al. | |
| 11,139,157 | B2 * | 10/2021 | Cooks | H01J 49/0413 |
| 2011/0192968 | A1 * | 8/2011 | Makarov | H01J 49/167 250/288 |
| 2013/0280819 | A1 * | 10/2013 | Cooks | H01J 49/0445 250/288 |
| 2013/0287962 | A1 * | 10/2013 | Deng | B05B 5/0533 204/600 |
| 2014/0116160 | A1 * | 5/2014 | St. Cyr | B01L 9/50 73/864.91 |
| 2014/0224981 | A1 | 8/2014 | Owen et al. | |

OTHER PUBLICATIONS

Gao, 2008, Design and Characterization of a Multisource Hand-Held Tandem Mass Spectrometer, Anal. Chem. 80:7198-7205.

Gao, 2006, Handheld Rectilinear Ion Trap Mass Spectrometer, Anal. Chem., 78:5994-6002.

Hagar, 2002, A new linear ion trap mass spectromer, Rapid Communi. Mass Spectrometry, 16(6):512-526.

Hendricks, 2014, Autonomous in-situ analysis and real-time chemical detection using a backpack miniature mass spectrometer: concept, instrumentation development and performance, Anal. Chem., 86:2900-2908.

Hou, 2011, Sampling Wand for an Ion Trap Mass Spectrometer, Anal. Chem, 83:1857-1861.

Li, 2014, Miniature Ambient Mass Analysis System, Anal. Chem., 86:2909-2916.

Sokol, 2014 Miniature mass spectrometer equipped with electrospray and desorption electrospray ionization for direct analysis of organics from solids and solutions, Int. J. Mass Spectrom., 306:182-195.

* cited by examiner

Spike Information

| Target Peptide 581 Concentration (uM) | Internal Standard 585 Concentration (uM) | 581/585 in spike |
|---|---|---|
| 0.3 | 1 | 0.3 |
| 0.6 | 1 | 0.6 |
| 1 | 1 | 1 |
| 2 | 1 | 2 |
| 4 | 1 | 4 |

| Spike Information | | |
|---|---|---|
| Target Peptide 581 Concentration (uM) | Internal Standard 585 Concentration (uM) | 581/585 in spike |
| 0.3 | 0.15 | 2 |
| 0.6 | 0.15 | 4 |
| 1 | 0.15 | 6.666666667 |
| 2 | 0.15 | 13.33333333 |
| 4 | 0.15 | 26.66666667 |

MULTIPLEXED INDUCTIVE IONIZATION SYSTEMS AND METHODS

RELATED APPLICATION

The present application is a continuation of U.S. nonprovisional patent application Ser. No. 16/885,540, filed May 28, 2020, which claims the benefit of and priority to U.S. provisional patent application Ser. No. 62/855,090, filed May 31, 2019, the content of each of which is incorporated by reference herein in its entirety.

FIELD OF THE INVENTION

The invention generally relates to multiplexed inductive ionization systems and methods.

BACKGROUND

Bioassays are key tasks in the pharmaceutical and biopharmaceutical industries and mass spectrometry (MS) is a key label-free technique. It is used for optimization of reaction conditions, study of reaction kinetics, determination of substrate $K_m$ and of product purity including genotoxic by-product quantitation. High-throughput, target-based screening has become a staple of the drug discovery process. The introduction of robotic systems for sample preparation and plate handling enables bioassays to be run in a fully automated fashion, which allows assessment of the functional activity of small molecule compound libraries at scales in the order of millions of compounds. Optical detection formats such as absorbance, fluorescence and luminescence are well suited to high-throughput screening (HTS) due to the rapid nature of the measurement (ca. 10-100 ms/sample). Though effective, not all bioassays are inherently suited to optical detection due to labelling reactivity, interference of the biological matrix and the emerging demands for intact molecule bioassays. For these reasons, mass spectrometry (MS) is widely considered an attractive alternative to optical detection methods for HTS bioassays, due to its inherent selectivity, sensitivity and label-free characteristics. The complex biological matrices encountered may require sample pretreatment but this must be limited if bioassays are to be performed at appropriate speeds. Some sample pretreatment is needed but it must be fast or analysis must be multiplexed, or both. Liquid Chromatography—Mass Spectrometry (LC-MS) is the standard method of pretreatment. Even very rapid versions using this technology require 1 to 15 minutes per sample, meaning that 1 million samples need about 2 years for analysis. Automated solid phase extraction (RapidFire, Agilent, Inc.) requires 10 seconds per sample for a simple pretreatment separation. Hence 1 million samples need 116 days for analysis. MALDI requires 0.3 seconds per sample, which is good speed, but the sample preparation (matrix addition) complicates the sample and makes small molecule analysis difficult. 1 million samples need 4 days to analyze. A new method of levitated droplet (ECHO-MS) analysis addresses the speed issue (0.5-1 s/sample) and to some extent improves the sample matrix. Assay rates are 1 second per sample so 1 million samples needs 12 days for analysis. For MALDI and ECHO-MS, the sacrifice in separation increases the HTS rate but can lead to loss of specificity and sensitivity in bioassays; methods enabling both high-throughput and efficient separation and analysis remain in high demand.

Nanoelectrospray ionization (nESI) is highly sensitive and one of the most robust sample introduction methods used for MS-based analysis of biological samples. The common implementation of nESI uses tapered emitters pulled from glass tubes. Nevertheless, the outstanding analytical performance of nESI has not been exploited for HTS analysis because the sample introduction step in nESI has only been done manually. As discussed herein, our group has developed inductive nESI which enables the ionization of liquid samples using a remote electrode. Inductive nESI, better termed inductive picoelectrospray (pL/min @ flow rate of spray solvent, pESI) can perform reliable analysis from small confined volumes including droplets and single cells with sensitivity down to the zeptomole level. When either a static or alternating electrical field is applied to initiate inductive nESI, the polarization of the liquid causes the spatial separation of ions, allowing in situ micro-electrophoresis. This effect becomes particularly significant when: a) sample amounts are at the nanoliter level and b) the electrical field applied to initiate inductive nESI is also used to effect micro-electrophoresis. We hypothesize that the combination of inductive nESI with high performance micro-electrophoresis could constitute a promising approach for HTS bioassays.

SUMMARY

The invention recognizes that the growing demand for high-throughput MS based assays in the pharmaceutical industry challenges both the sensitivity and throughput of any analytical method. While nanoelectrospray ionization mass spectrometry (nESI-MS) is an ultra-sensitive analytical tool, the current work flow of nESI means that the sample needs to be pipetted into an emitter tip and that gravitational force is needed to make sure all the sample solution is loaded into the tip of the emitter. Automation is possible with larger spray systems (e.g. flow injection methods work well for ESI or electrosonic spray both of which give similar ion currents and mass spectra but require much more sample than nESI). However, the unavailability of automation restricts the throughput and application of nESI.

To solve these problems, the invention provides a multiplexed system for high-throughput analysis of samples from 96 and 384-well plate. A "dip and go" sample introduction strategy allows simultaneous immersion of multiple nanoelectrospray emitters with 20-micron tip size into sample solutions in 96 or 384-well plates. The sample volume in the emitter is about 100 nL. Inductive nESI (e.g., inductive DC nESI) enables ultra-sensitive mass spectrometric analysis of nanoliter volume samples. It is a further advantage of this configuration that electrophoretic cleaning (desalting) can be readily effected by stepping, for example, an applied DC potential. Electrophoretic cleaning occurs inductively and is very fast; it removes salts from the vicinity of the emitter tip allowing high quality spectra of analytes to be recorded. As shown herein, high-throughput quantification of peptides in concentrations as low as 300 nM in complex matrices is achieved. In contrast, the fastest analysis rate of the current version of the inductive nESI system is 1.4 seconds per sample.

The systems and methods of the invention provide certain unique advantages over prior art approaches. For example, by employing inductive nESI, the sample is not in contact with the electrode, avoiding contamination and carryover. The systems of the invention enable ionization of nanoliter volume samples in the emitter, and the system is compatible with a dip loading strategy.

With the "Dip and go" loading strategy, sample solution used for assays is transferred to the emitters for subsequent analysis by immersing the emitter tip into sample solution for about 20 seconds. This procedure can be done in parallel to load samples into 12 (or more) channels simultaneously. The emitters are loaded into a holder on a moving stage for automated inductive nESI analysis in sequence. This allows for a fast analysis rate. For example, the data herein show that an analysis rate of 1.4 seconds per sample has been achieved.

Electrophoretic cleaning may be achieved using an inductive field applied within the nESI emitters and then simply modulating the magnitude of the spray voltage. Other electrophoretic approaches are discussed herein. The time needed for the cleaning is about 10 seconds prior to inductive nESI analysis. This procedure can be done for all emitters simultaneously before analysis (off-line) or during inductive nESI analysis with the emitters being subjected to cleaning and analysis in sequence (on-line). The cleaning and analysis steps can be performed sequentially from the same array.

BRIEF DESCRIPTION OF THE DRAWINGS

FIG. 14 panel B shows a typical TIC and EIC of dip-and-go analysis of one row of samples. FIG. 14 panel C shows IC50 of inhibitor OM99-2 to BACE1 determined using the dip-and-go system.

DETAILED DESCRIPTION

Figure 1A:
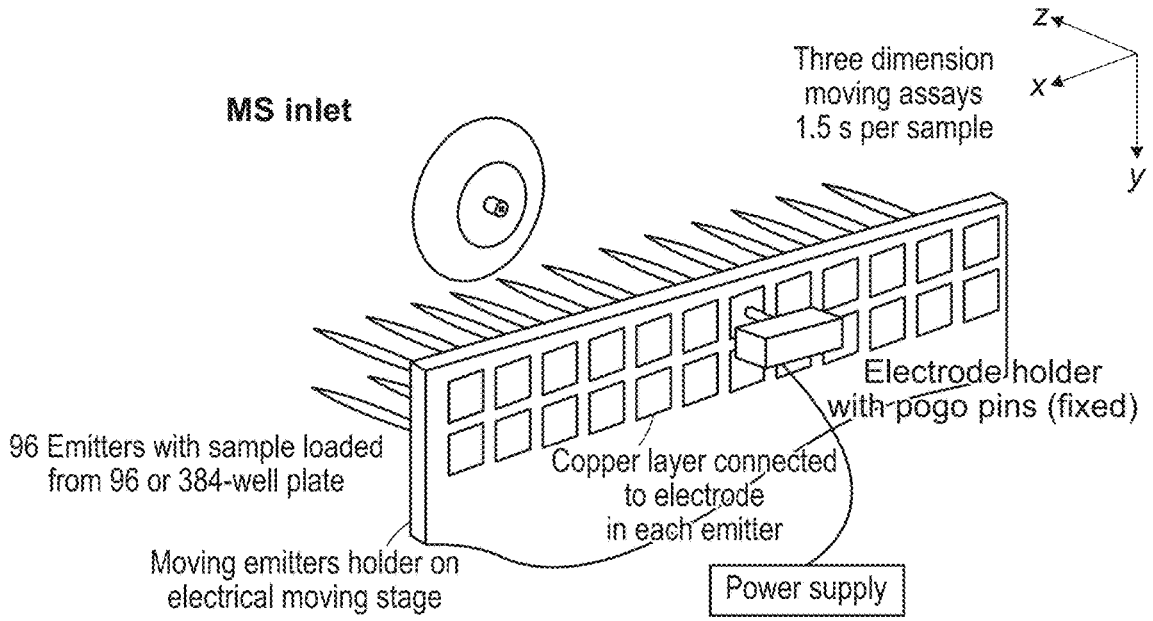
FIG. 1A is a schematic diagram of an embodiment of an induced DC nESI array analysis system. Emitters (12*8) preloaded with sample are placed on the emitter holder. The emitter holder can move in the x, y and z directions in the coordinate system shown at the top right. When analyzing the samples, the emitter holder moves in the y direction to go to the start of one row of samples and then moves in the x direction to scan the 12 samples. This procedure repeats row by row to finish the analysis of 96 samples in the holder. While the holder is moving, the pogo pin touches the copper layer that contacts the corresponding electrode. The pogo pin holder is fixed at the proper position to align with the MS inlet. When the emitter holder moves, the sample in the emitter that is aligned with MS inlet is ionized and MS analysis is performed.
Figure 1B:
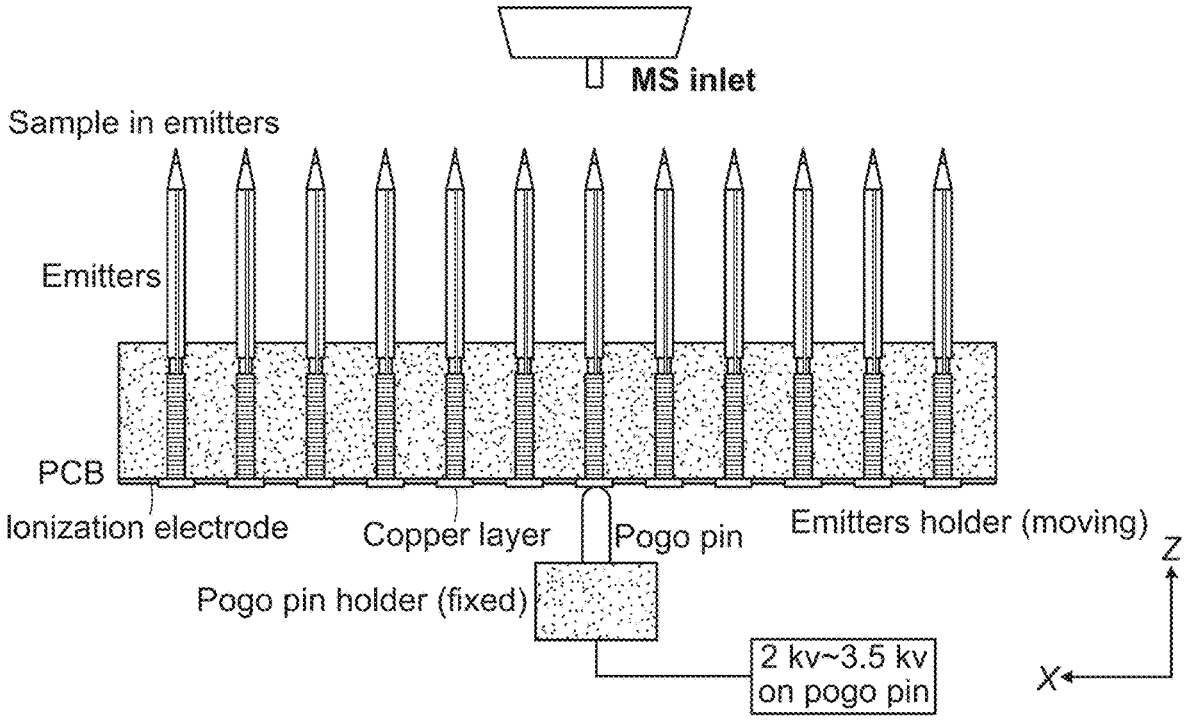
FIG. 1B is a Top view of the emitter holder and details of the electrode and emitter arrangement in the emitter holder.

FIGS. 1A-B illustrate an exemplary system of the invention. In certain embodiments, the induced DC nESI ionization source includes a 3D electrical controlled moving platform, emitter holder and a pogo pin holder. FIGS. 1A-B show how the device works in an exemplary embodiment. In this embodiment, the emitter holder is preloaded with 96 emitters and samples. The emitter holder is attached to the 3D moving stage by a 3D printed connector. The emitter holder is designed to easily attached and detached from the moving stage for convenience of sample introduction and cleaning. The front (side facing the MS inlet) of the emitter holder has 96 holes to hold 96 emitters. Inside the holes, there are 96 individual electrodes with the same length as the emitter holder. When loading the emitters into the holder, these electrodes are inserted into the emitters but do not reach the sample solution. The other ends of the electrodes go from the rear (side opposite from the MS inlet) and are soldered to a PCB with 96 holes. On the PCB, there are 96 isolated copper layers electrically in contact with the 96 electrodes by soldering. A pogo pin electrode placed behind the PCB is aligned with the MS inlet. The position of the pogo pin electrode is fixed by the pogo pin holder on a fixed arm of the 3D moving stage. The pogo pin electrode touches the PCB. When the device is running, the motion control system first goes to the top right starting point and moves in the vertical y-direction to find the first row of emitters and then moves in the horizontal x-direction to analyze samples in the first row in sequence. When an emitter is aligned with the MS inlet, the pogo pin touches the corresponding copper layer on the PCB and 2~3.5 kV volts is applied to the electrode for induced DC nESI ionization of the sample in the tip of the emitter. Note that the electrode does not contact the sample so ionization is induced. Because the flow rate in inductive nESI is very low, so there is enough time to record the high-quality MS data in spite of very small sample volume.

Figure 2:
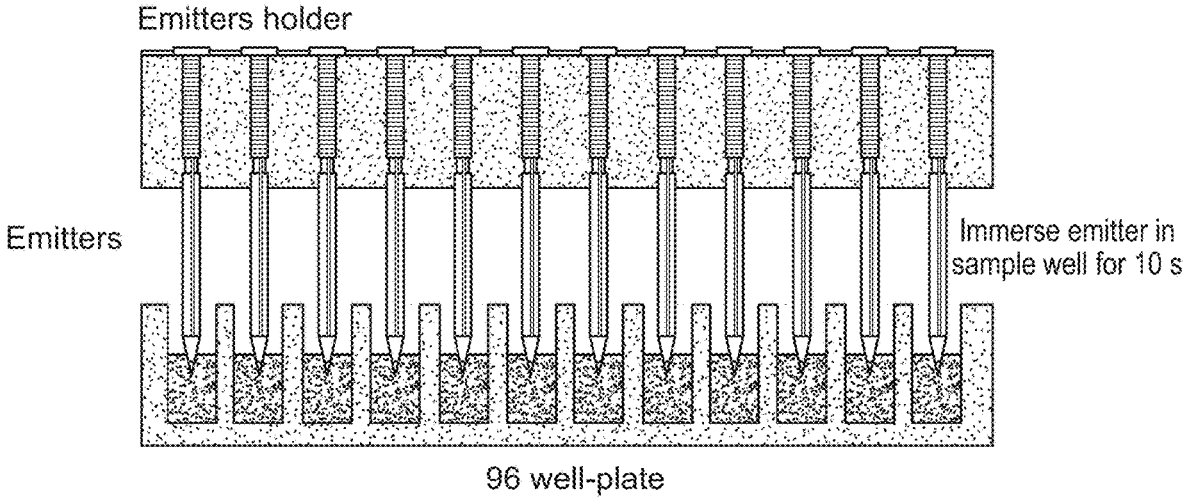
FIG. 2 illustrates a dip and go strategy for sample introduction from 96-well plate into all emitters simultaneously. The emitter holder can be detached from the 3D moving stage for sample introduction and offline electrophoretic cleaning. The sample load amount is ca. 100 nL.

To solve the problem of sample introduction presented by the traditional nESI work flow, we have developed a "dip and go" strategy using a multiplexed system. As shown in FIG. 2, 96 emitters with 20-micron tip size are preloaded into the emitter holder. The size of the holder is designed to correspond to the size of the standard 96-well plate and the position of each emitter corresponds to the position of each well in the 96-well plate. To load the sample, one holds the emitter holder and lets the side with emitters face the 96-well plate, lowers the holder and allows every emitter to be immersed into sample solution for 10 seconds and then lifts the holder. This procedure can be done manually or with a robot. The amount of sample solution introduced into emitter is ca. 100 nL. Sample loading amounts can be varied by using different loading times.

Figure 3A:
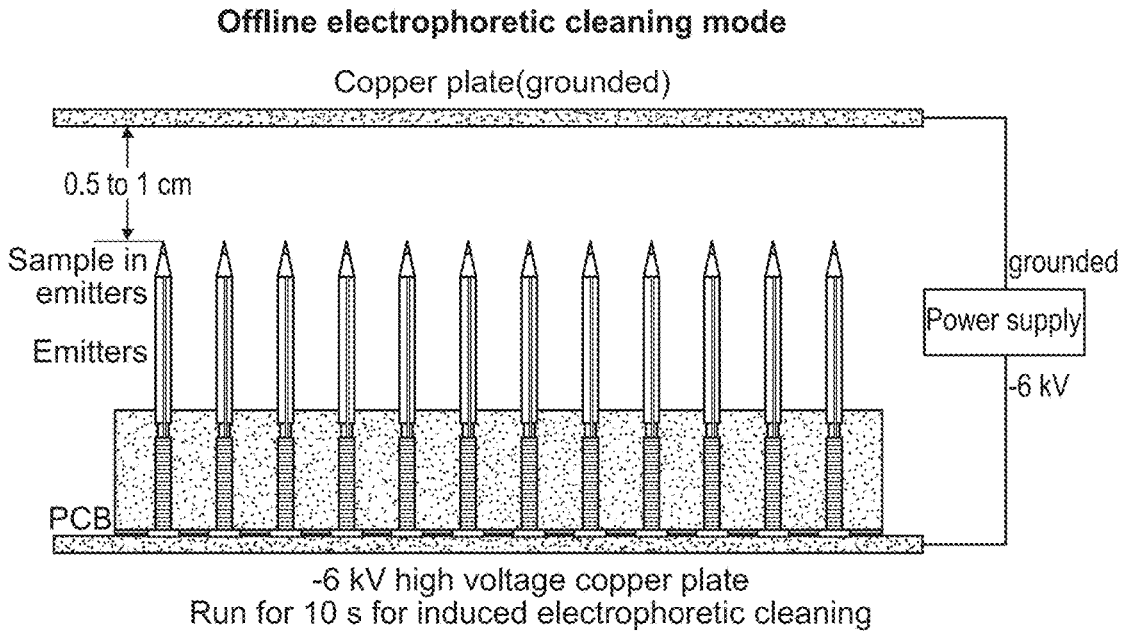
FIGS. 3A-B are schematic diagrams showing offline and online electrophoretic cleaning work flow.
Figure 3B:
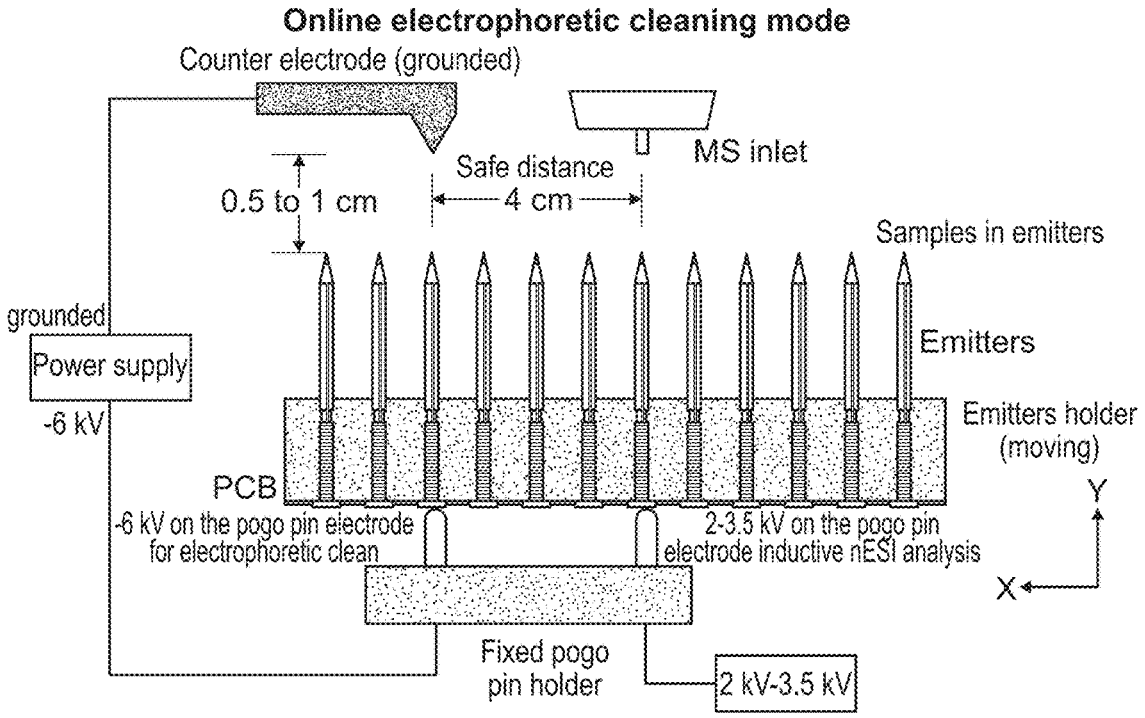

FIGS. 3A-B illustrate various electrophoretic cleaning approaches. Induced electrophoretic cleaning ("desalting") can be applied to the samples on the emitters prior to sample analysis to achieve better analytical performance for samples with a complex matrix. By applying voltage (e.g., more than 5 kV, with either the same or opposite polarity to that used for nESI analysis) to the electrodes simultaneously, the high electrical field induced in the sample in the emitter tip will cause electrophoresis. Ions with large ionic mobility such as anions and cations from simple salts in the solution will migrate towards the two ends of the solution, leaving substances with small ionic mobility such as peptides will remain essentially in their original positions and will be subject to selective ionization.

To perform offline electrophoretic cleaning one holds the emitter holder and allows the copper layer of the PCB touch a copper plate connected to the high voltage output of a power supply. At 0.5 to 1 cm distance from the emitter tip, another copper plate which is grounded is placed so as to set up a large potential change in the sample solution to initiate electrophoresis. The electrophoresis is maintained for 10 seconds and then the emitter holder is re-installed onto the back to the 3D moving stage platform. Following the same steps described in section A one records spectra of the cleaned samples. This method is more convenient but slightly slower (because cleaning slightly slows the rate of motion used for ionization).

The alternative to offline cleaning is to perform online cleaning using one HV supply for cleaning and a second one for ionization. To perform online electrophoretic cleaning, the emitter holder is attached to the moving stage. When performing the cleaning, the moving stage allows the emitter holder to move from left to right. The left pogo pin on a pogo pin holder is supplied with −6 kV volts to induce electrophoretic cleaning of the sample that points towards the grounded counter electrode. Subsequently, after cleaning, the emitter moves and is aligned with the MS inlet at which point the right pogo pin electrode with 2 to 3.5 kV volts applied to the pogo pin holder initiates inductive nESI analysis of sample in the emitter by the same process described in A. This method is faster and the sample screening rate can be maximized Inductive Charging Inductive charging is described for example in U.S. Pat. No. 9,184,036, the content of which is incorporated by reference herein in its entirety. In inductive charging the probe includes a spray emitter and a voltage source and the probe is configured such that the voltage source is not in contact with the spray emitter or the spray emitted by the spray emitter. In this manner, the ions are generated by inductive charging, i.e., an inductive method is used to charge the primary microdroplets. This allows droplet creation to be synchronized with the opening of the sample introduction system (and also with the pulsing of the nebulizing gas). Inductive nESI can be implemented for various kinds of nESI arrays due to the lack of physical contact. Examples include circular and linear modes. In an exemplary rotating array, an electrode placed~2 mm from each of the spray emitters in turn is supplied with a 2-4 kV positive pulse (10-3000 Hz) giving a sequence of ion signals. Simultaneous or sequential ions signals can be generated in the linear array using voltages generated inductively in adjacent nESI emitters. Nanoelectrospray spray plumes can be observed and analytes are detected in the mass spectrum, in both positive and negative detection modes. In the electrophoretic clean-up working mode, direct current voltage source (1.5-6 kV) was used to induce nanoelectrospray. Different from the previous example induced by alternating current voltage, the induced electrical field keeps the same direction in this mode, which ensures efficient electrophoretic cleaning performance Ion Traps and Mass Spectrometers Any ion trap known in the art can be used in systems of the invention. Exemplary ion traps include a hyperbolic ion trap (e.g., U.S. Pat. No. 5,644,131, the content of which is incorporated by reference herein in its entirety), a cylindrical ion trap (e.g., Bonner et al., International Journal of Mass Spectrometry and Ion Physics, 24(3):255-269, 1977, the content of which is incorporated by reference herein in its entirety), a linear ion trap (Hagar, Rapid Communications in Mass Spectrometry, 16(6):512-526, 2002, the content of which is incorporated by reference herein in its entirety), and a rectilinear ion trap (U.S. Pat. No. 6,838,666, the content of which is incorporated by reference herein in its entirety).

Any mass spectrometer (e.g., bench-top mass spectrometer of miniature mass spectrometer) may be used in systems of the invention and in certain embodiments the mass spectrometer is a miniature mass spectrometer. An exemplary miniature mass spectrometer is described, for example in Gao et al. (Anal. Chem. 2008, 80, 7198-7205.), the content of which is incorporated by reference herein in its entirety. In comparison with the pumping system used for lab-scale instruments with thousands of watts of power, miniature mass spectrometers generally have smaller pumping systems, such as a 18 W pumping system with only a 5 L/min (0.3 $m^3$/hr) diaphragm pump and a 11 L/s turbo pump for the system described in Gao et al. Other exemplary miniature mass spectrometers are described for example in Gao et al. (Anal. Chem., 2008, 80, 7198-7205.), Hou et al. (Anal. Chem., 2011, 83, 1857-1861.), and Sokol et al. (Int. J. Mass Spectrom., 2011, 306, 187-195), the content of each of which is incorporated herein by reference in its entirety.

Figure 9:
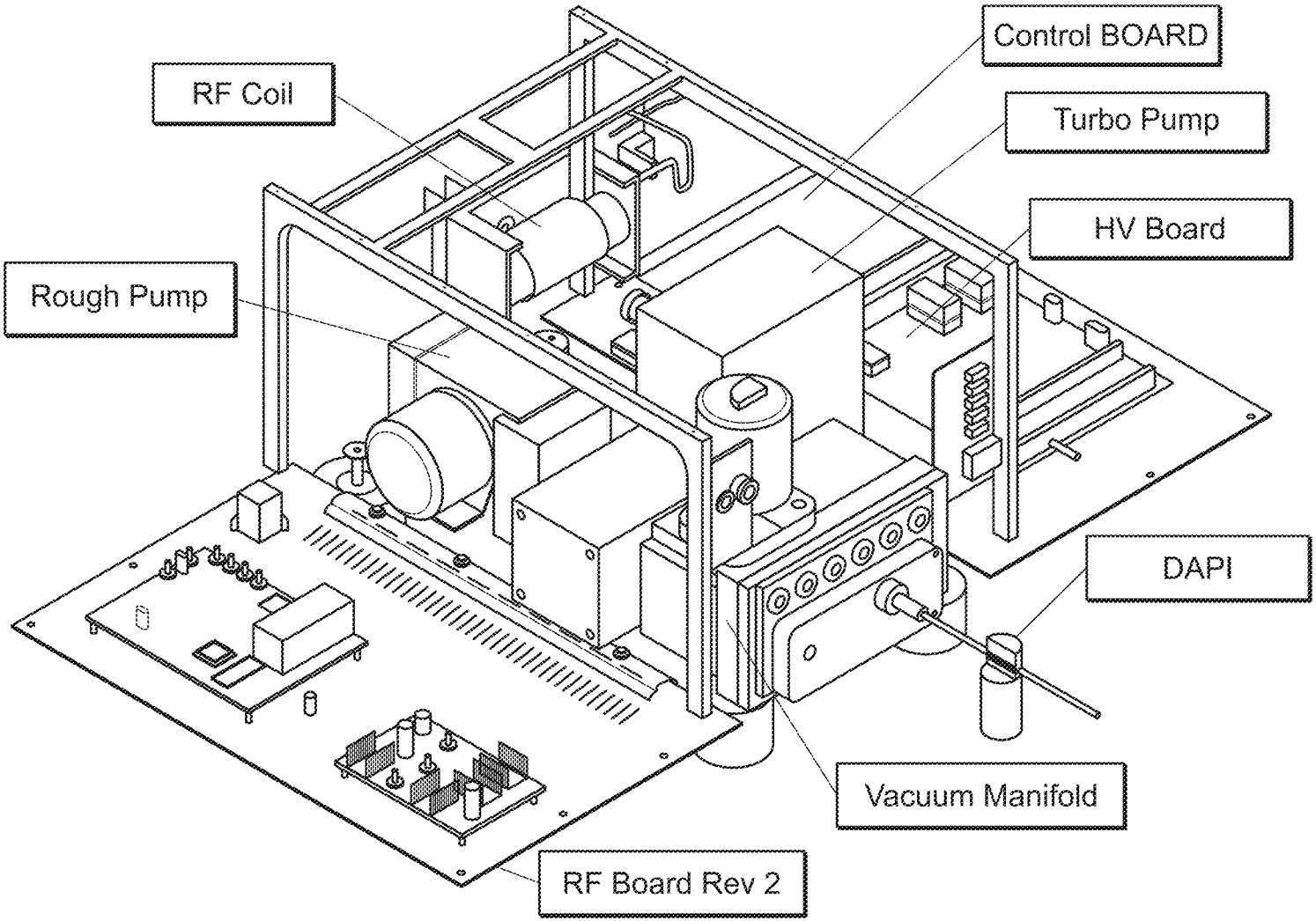
FIG. 9 is a picture illustrating various components and their arrangement in a miniature mass spectrometer.

FIG. 9 is a picture illustrating various components and their arrangement in a miniature mass spectrometer. The control system of the Mini 12 (Linfan Li, Tsung-Chi Chen, Yue Ren, Paul I. Hendricks, R. Graham Cooks and Zheng Ouyang "Miniature Ambient Mass Analysis System" Anal. Chem. 2014, 86 2909-2916, DOI: 10.1021/ac403766c; and 860.

Paul Hendricks, Jon K. Dalgleish, Jacob T. Shelley, Matthew A. Kirleis, Matthew T. McNicholas, Linfan Li, Tsung-Chi Chen, Chien-Hsun Chen, Jason S. Duncan, Frank Boudreau, Robert J. Noll, John P. Denton, Timothy A. Roach, Zheng Ouyang, and R. Graham Cooks "Autonomous in-situ analysis and real-time chemical detection using a backpack miniature mass spectrometer: concept, instrumentation development, and performance" Anal. Chem., 2014, 86 2900-2908 DOI: 10.1021/ac403765x, the content of each of which is incorporated by reference herein in its entirety), and the vacuum system of the Mini 10 (Liang Gao, Qingyu Song, Garth E. Patterson, R. Graham Cooks and Zheng Ouyang, "Handheld Rectilinear Ion Trap Mass Spectrometer", Anal. Chem., 78 (2006) 5994-6002 DOI: 10.1021/ac061144k, the content of which is incorporated by reference herein in its entirety) may be combined to produce the miniature mass spectrometer shown in FIG. 9. It may have a size similar to that of a shoebox (H20 cm×W25 cm×D35 cm). In certain embodiments, the miniature mass spectrometer uses a dual LIT configuration, which is described for example in Owen et al. (U.S. patent application Ser. No. 14/345,672), and Ouyang et al. (U.S. patent application Ser. No. 61/865,377), the content of each of which is incorporated by reference herein in its entirety.

System Architecture

Figure 10:
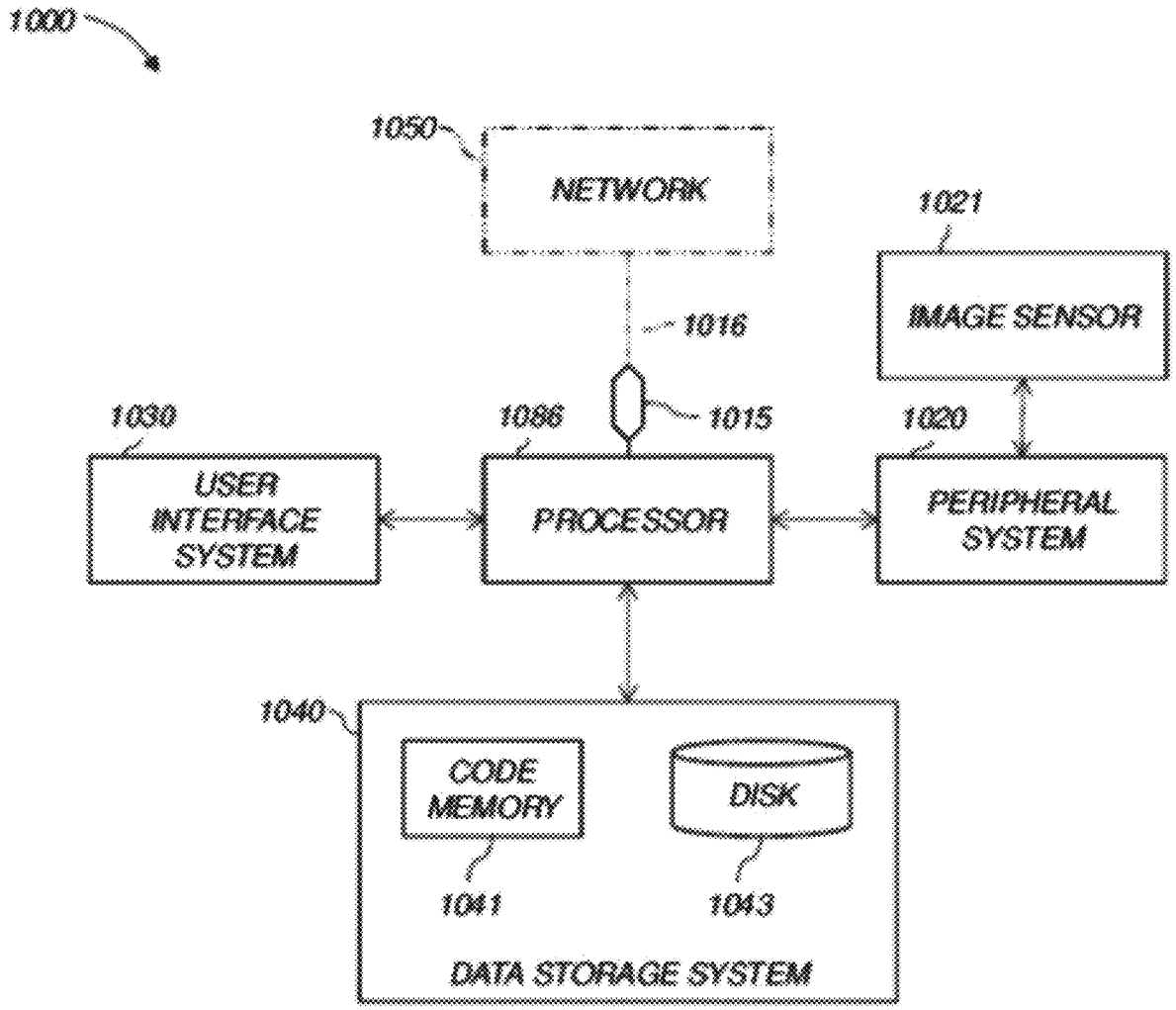
FIG. 10 shows a high-level diagram of the components of an exemplary data-processing system for analyzing data and performing other analyses described herein, and related components.

FIG. 10 is a high-level diagram showing the components of an exemplary data-processing system 1000 for analyzing data and performing other analyses described herein, and related components. The system includes a processor 1086, a peripheral system 1020, a user interface system 1030, and a data storage system 1040. The peripheral system 1020, the user interface system 1030 and the data storage system 1040 are communicatively connected to the processor 1086. Processor 1086 can be communicatively connected to network 1050 (shown in phantom), e.g., the Internet or a leased line, as discussed below. The data described above may be obtained using detector 1021 and/or displayed using display units (included in user interface system 1030) which can each include one or more of systems 1086, 1020, 1030, 1040, and can each connect to one or more network(s) 1050. Processor 1086, and other processing devices described herein, can each include one or more microprocessors, microcontrollers, field-programmable gate arrays (FPGAs), application-specific integrated circuits (ASICs), programmable logic devices (PLDs), programmable logic arrays (PLAs), programmable array logic devices (PALs), or digital signal processors (DSPs).

Processor 1086 which in one embodiment may be capable of real-time calculations (and in an alternative embodiment configured to perform calculations on a non-real-time basis and store the results of calculations for use later) can implement processes of various aspects described herein. Processor 1086 can be or include one or more device(s) for automatically operating on data, e.g., a central processing unit (CPU), microcontroller (MCU), desktop computer, laptop computer, mainframe computer, personal digital assistant, digital camera, cellular phone, smartphone, or any other device for processing data, managing data, or handling data, whether implemented with electrical, magnetic, optical, biological components, or otherwise. The phrase "communicatively connected" includes any type of connection, wired or wireless, for communicating data between devices or processors. These devices or processors can be located in physical proximity or not. For example, subsystems such as peripheral system 1020, user interface system 1030, and data storage system 1040 are shown separately from the data processing system 1086 but can be stored completely or partially within the data processing system 1086.

The peripheral system 1020 can include one or more devices configured to provide digital content records to the processor 1086. For example, the peripheral system 1020 can include digital still cameras, digital video cameras, cellular phones, or other data processors. The processor 1086, upon receipt of digital content records from a device in the peripheral system 1020, can store such digital content records in the data storage system 1040.

The user interface system 1030 can include a mouse, a keyboard, another computer (e.g., a tablet) connected, e.g., via a network or a null-modem cable, or any device or combination of devices from which data is input to the processor 1086. The user interface system 1030 also can include a display device, a processor-accessible memory, or any device or combination of devices to which data is output by the processor 1086. The user interface system 1030 and the data storage system 1040 can share a processor-accessible memory.

In various aspects, processor 1086 includes or is connected to communication interface 1015 that is coupled via network link 1016 (shown in phantom) to network 1050. For example, communication interface 1015 can include an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM. Communication interface 1015 sends and receives electrical, electromagnetic or optical signals that carry digital or analog data streams representing various types of information across network link 1016 to network 1050. Network link 1016 can be connected to network 1050 via a switch, gateway, hub, router, or other networking device.

Processor 1086 can send messages and receive data, including program code, through network 1050, network link 1016 and communication interface 1015. For example, a server can store requested code for an application program (e.g., a JAVA applet) on a tangible non-volatile computer-readable storage medium to which it is connected. The server can retrieve the code from the medium and transmit it through network 1050 to communication interface 1015. The received code can be executed by processor 1086 as it is received, or stored in data storage system 1040 for later execution.

Data storage system 1040 can include or be communicatively connected with one or more processor-accessible memories configured to store information. The memories can be, e.g., within a chassis or as parts of a distributed system. The phrase "processor-accessible memory" is intended to include any data storage device to or from which processor 1086 can transfer data (using appropriate components of peripheral system 1020), whether volatile or non-volatile; removable or fixed; electronic, magnetic, optical, chemical, mechanical, or otherwise. Exemplary processor-accessible memories include but are not limited to: registers, floppy disks, hard disks, tapes, bar codes, Compact Discs, DVDs, read-only memories (ROM), Universal Serial Bus (USB) interface memory device, erasable programmable read-only memories (EPROM, EEPROM, or Flash), remotely accessible hard drives, and random-access memories (RAMs). One of the processor-accessible memories in the data storage system 1040 can be a tangible non-transitory computer-readable storage medium, i.e., a non-transitory device or article of manufacture that participates in storing instructions that can be provided to processor 1086 for execution.

In an example, data storage system 1040 includes code memory 1041, e.g., a RAM, and disk 1043, e.g., a tangible computer-readable rotational storage device such as a hard drive. Computer program instructions are read into code memory 1041 from disk 1043. Processor 1086 then executes one or more sequences of the computer program instructions loaded into code memory 1041, as a result performing process steps described herein. In this way, processor 1086 carries out a computer implemented process. For example, steps of methods described herein, blocks of the flowchart illustrations or block diagrams herein, and combinations of those, can be implemented by computer program instructions. Code memory 1041 can also store data, or can store only code.

Various aspects described herein may be embodied as systems or methods. Accordingly, various aspects herein may take the form of an entirely hardware aspect, an entirely software aspect (including firmware, resident software, micro-code, etc.), or an aspect combining software and hardware aspects. These aspects can all generally be referred to herein as a "service," "circuit," "circuitry," "module," or "system."

Furthermore, various aspects herein may be embodied as computer program products including computer readable program code stored on a tangible non-transitory computer readable medium. Such a medium can be manufactured as is conventional for such articles, e.g., by pressing a CD-ROM. The program code includes computer program instructions that can be loaded into processor 1086 (and possibly also other processors) to cause functions, acts, or operational steps of various aspects herein to be performed by the processor 1086 (or other processor). Computer program code for carrying out operations for various aspects described herein may be written in any combination of one or more programming language(s), and can be loaded from disk 1043 into code memory 1041 for execution. The program code may execute, e.g., entirely on processor 1086, partly on processor 1086 and partly on a remote computer connected to network 1050, or entirely on the remote computer.

Discontinuous Atmospheric Pressure Interface (DAPI)

In certain embodiments, the systems of the invention can be operated with a Discontinuous Atmospheric Pressure Interface (DAPI). A DAPI is particularly useful when coupled to a miniature mass spectrometer, but can also be used with a standard bench-top mass spectrometer. Discontinuous atmospheric interfaces are described in Ouyang et al. (U.S. Pat. No. 8,304,718 and PCT application number PCT/US2008/065245), the content of each of which is incorporated by reference herein in its entirety.

In certain embodiments, operation of the DAPI is synchronized with operation of the probes of the invention, particularly when using a miniature mass spectrometer, as described in U.S. Pat. No. 9,184,036, the content of which is incorporated by reference herein in its entirety.

Samples

A wide range of heterogeneous samples can be analyzed, such as biological samples, environmental samples (including, e.g., industrial samples and agricultural samples), and food/beverage product samples, etc.

Exemplary environmental samples include, but are not limited to, groundwater, surface water, saturated soil water, unsaturated soil water; industrialized processes such as waste water, cooling water; chemicals used in a process, chemical reactions in an industrial processes, and other systems that would involve leachate from waste sites; waste and water injection processes; liquids in or leak detection around storage tanks; discharge water from industrial facilities, water treatment plants or facilities; drainage and leachates from agricultural lands, drainage from urban land uses such as surface, subsurface, and sewer systems; waters from waste treatment technologies; and drainage from mineral extraction or other processes that extract natural resources such as oil production and in situ energy production.

Additionally exemplary environmental samples include, but certainly are not limited to, agricultural samples such as crop samples, such as grain and forage products, such as soybeans, wheat, and corn. Often, data on the constituents of the products, such as moisture, protein, oil, starch, amino acids, extractable starch, density, test weight, digestibility, cell wall content, and any other constituents or properties that are of commercial value is desired.

Exemplary biological samples include a human tissue or bodily fluid and may be collected in any clinically acceptable manner. A tissue is a mass of connected cells and/or extracellular matrix material, e.g. skin tissue, hair, nails, nasal passage tissue, CNS tissue, neural tissue, eye tissue, liver tissue, kidney tissue, placental tissue, mammary gland tissue, placental tissue, mammary gland tissue, gastrointestinal tissue, musculoskeletal tissue, genitourinary tissue, bone marrow, and the like, derived from, for example, a human or other mammal and includes the connecting material and the liquid material in association with the cells and/or tissues. A body fluid is a liquid material derived from, for example, a human or other mammal. Such body fluids include, but are not limited to, mucous, blood, plasma, serum, serum derivatives, bile, blood, maternal blood, phlegm, saliva, sputum, sweat, amniotic fluid, menstrual fluid, mammary fluid, peritoneal fluid, urine, semen, and cerebrospinal fluid (CSF), such as lumbar or ventricular CSF. A sample may also be a fine needle aspirate or biopsied tissue. A sample also may be media containing cells or biological material. A sample may also be a blood clot, for example, a blood clot that has been obtained from whole blood after the serum has been removed.

In one embodiment, the biological sample can be a blood sample, from which plasma or serum can be extracted. The blood can be obtained by standard phlebotomy procedures and then separated. Typical separation methods for preparing a plasma sample include centrifugation of the blood sample. For example, immediately following blood draw, protease inhibitors and/or anticoagulants can be added to the blood sample. The tube is then cooled and centrifuged, and can subsequently be placed on ice. The resultant sample is separated into the following components: a clear solution of blood plasma in the upper phase; the buffy coat, which is a thin layer of leukocytes mixed with platelets; and erythrocytes (red blood cells). Typically, 8.5 mL of whole blood will yield about 2.5-3.0 mL of plasma.

Blood serum is prepared in a very similar fashion. Venous blood is collected, followed by mixing of protease inhibitors and coagulant with the blood by inversion. The blood is allowed to clot by standing tubes vertically at room temperature. The blood is then centrifuged, wherein the resultant supernatant is the designated serum. The serum sample should subsequently be placed on ice.

Prior to analyzing a sample, the sample may be purified, for example, using filtration or centrifugation. These techniques can be used, for example, to remove particulates and chemical interference. Various filtration media for removal of particles includes filer paper, such as cellulose and membrane filters, such as regenerated cellulose, cellulose acetate, nylon, PTFE, polypropylene, polyester, polyethersulfone, polycarbonate, and polyvinylpyrolidone. Various filtration media for removal of particulates and matrix interferences includes functionalized membranes, such as ion exchange membranes and affinity membranes; SPE cartridges such as silica- and polymer-based cartridges; and SPE (solid phase extraction) disks, such as PTFE- and fiberglass-based. Some of these filters can be provided in a disk format for loosely placing in filter holdings/housings, others are provided within a disposable tip that can be placed on, for example, standard blood collection tubes, and still others are provided in the form of an array with wells for receiving pipetted samples. Another type of filter includes spin filters. Spin filters consist of polypropylene centrifuge tubes with cellulose acetate filter membranes and are used in conjunction with centrifugation to remove particulates from samples, such as serum and plasma samples, typically diluted in aqueous buffers.

Filtration is affected in part, by porosity values, such that larger porosities filter out only the larger particulates and smaller porosities filtering out both smaller and larger porosities. Typical porosity values for sample filtration are the 0.20 and 0.45 μm porosities. Samples containing colloidal material or a large amount of fine particulates, considerable pressure may be required to force the liquid sample through the filter. Accordingly, for samples such as soil extracts or wastewater, a pre-filter or depth filter bed (e.g. "2-in-1" filter) can be used and which is placed on top of the membrane to prevent plugging with samples containing these types of particulates.

In some cases, centrifugation without filters can be used to remove particulates, as is often done with urine samples. For example, the samples are centrifuged. The resultant supernatant is then removed and frozen.

After a sample has been obtained and purified, the sample can be analyzed to determine the concentration of one or more target analytes, such as elements within a blood plasma sample. With respect to the analysis of a blood plasma sample, there are many elements present in the plasma, such as proteins (e.g., Albumin), ions and metals (e.g., iron), vitamins, hormones, and other elements (e.g., bilirubin and uric acid). Any of these elements may be detected using methods of the invention. More particularly, methods of the invention can be used to detect molecules in a biological sample that are indicative of a disease state.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

EXAMPLES

Example 1: High-Throughput Screening of Bioassays

BACE1 is a Prototypical Enzyme for biochemical reaction screening. The formation of the product KTEEISEVNL (SEQ ID NO.: 1) (with internal standard KTEEISEVNL in which the L is modified as [L-13C6]-OH, herein after shown as KTEEISEVN[L-13C6]-OH) from the peptide substrate KTEEISEVNLDAEFRHDK (SEQ ID NO.: 2) is catalyzed by BACE1 enzyme. Addition of drugs such as OM99-2 can inhibit this reaction. Quantification of product peptide KTEEISEVNL (with internal standard) after the biological reaction in the bioassay is important to drug discovery.

We have performed bioassays in the first row of a 96-well plate. Each well holds 100 μL sample solution. For well #1, #2 and #3, the target degraded peptide KTEEISEVNL (m/z=581.5, doubly charge in positive mode) concentration is 1 μM, 2 μM and 4 μM, respectively. The internal standard isotopic labelled peptide KTEEISEVN[L-13C6]-OH (m/z=585.0, doubly charged in positive mode) concentration of well #1 to #3 is 1 μM. The other wells #4 to #6, #7 to #9 and #10 to #12 repeat the samples in well #1 to #3. All 12 sample solutions have a complex matrix: BACE1 2 nM; NaOAc/HAc 6 mM (pH=4.5); glycerol 1.5% (V: V); Brij-35 0.0003% (w/w); formic acid 1% (V:V).

Figure 4:
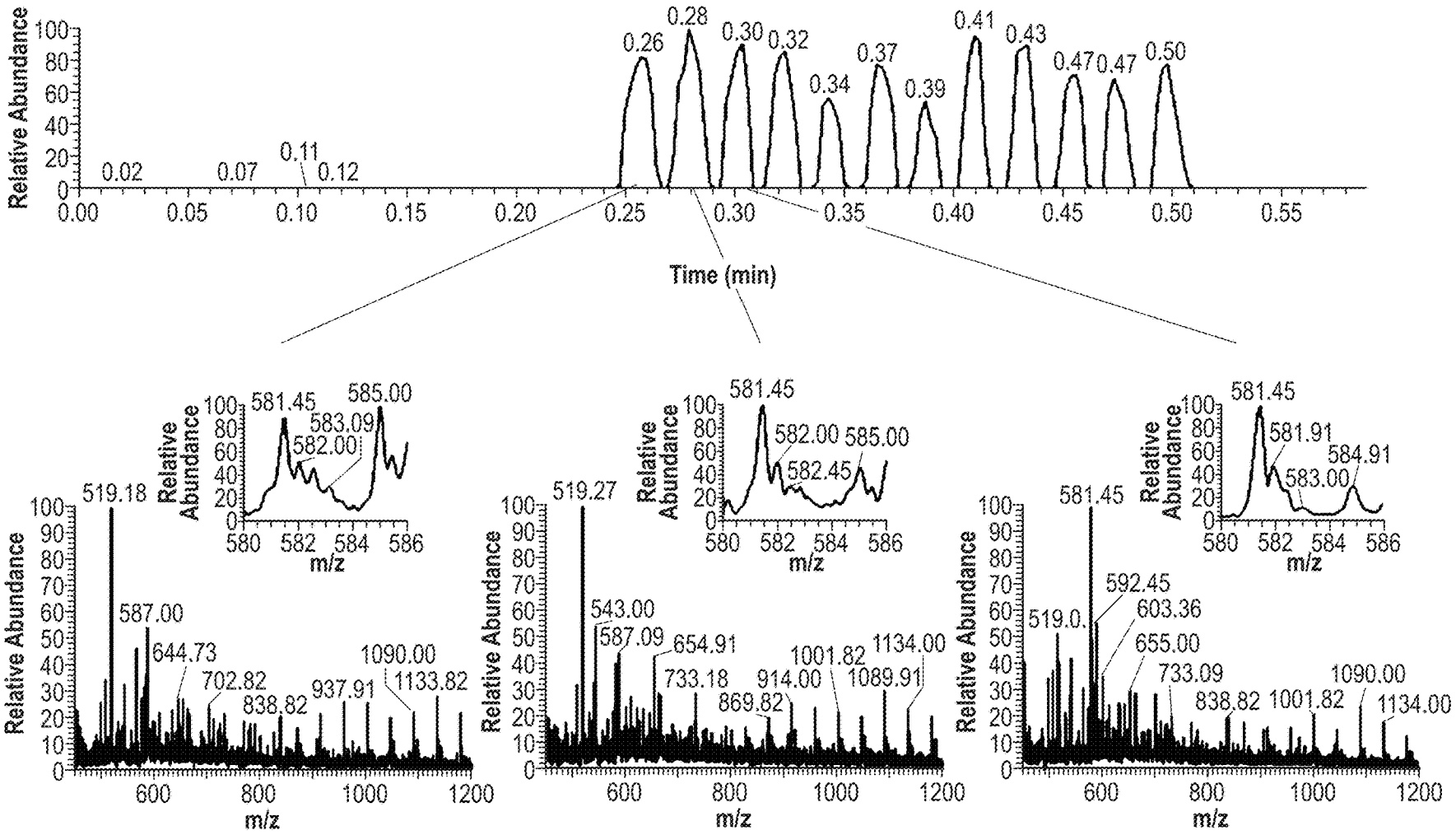
FIG. 4 shows the results of directly using the system to perform 12 bioassays using induced DC nESI. Top: total ion chronogram of 12 samples. Bottom: mass spectrum of peak #1 to #3 in TIC. This particular analysis is done without electrophoretic cleaning of samples.

FIG. 4 shows the results of directly using the system to perform 12 bioassays using induced DC nESI. At 0.24 minute (14.4 second), the pogo pin touches the copper layer electrically contacted to the electrode in the first emitter. Positive voltage of 3.5 kV is applied to this electrode for ca. 1 second for induced DC nESI of the sample; a peak is observed at 0.26 minute from the total ions chronogram (TIC) shown at top of FIG. 4, which is MS data for the first sample. One can observed 12 peaks in the TIC which correspond to samples from the 12 wells. From the TIC, we found the peak width is ca. 1 second and the total time used for analyzing 12 samples is 0.27 minute (16.2 seconds). This indicates that the analysis rate of the device is 1.4 seconds per sample. At the bottom of FIG. 4, the average mass spectra of sample #1 to #3 is shown. Due to the ion suppression effect caused by the complex matrix, the signals of the target peptide and the internal standard are not very high and the signal to noise ratio is low. When the m/z range is zoomed in to 580 to 586, the peaks at 581.5 (KTEEISEVNL, target peptide) and 585.0 (KTEEISEVN[L-13C6]-OH, internal standard) are distinguishable. The signal intensity ratio of 581.5 and 585.0 is 1:1, 2:1 and 4:1 of peak #1, #2 and #3 in the TIC, which are consistent with the spiked ratio of sample #1 to #3. Even at such high screening rate, no carryover of samples is observed.

Figure 5:
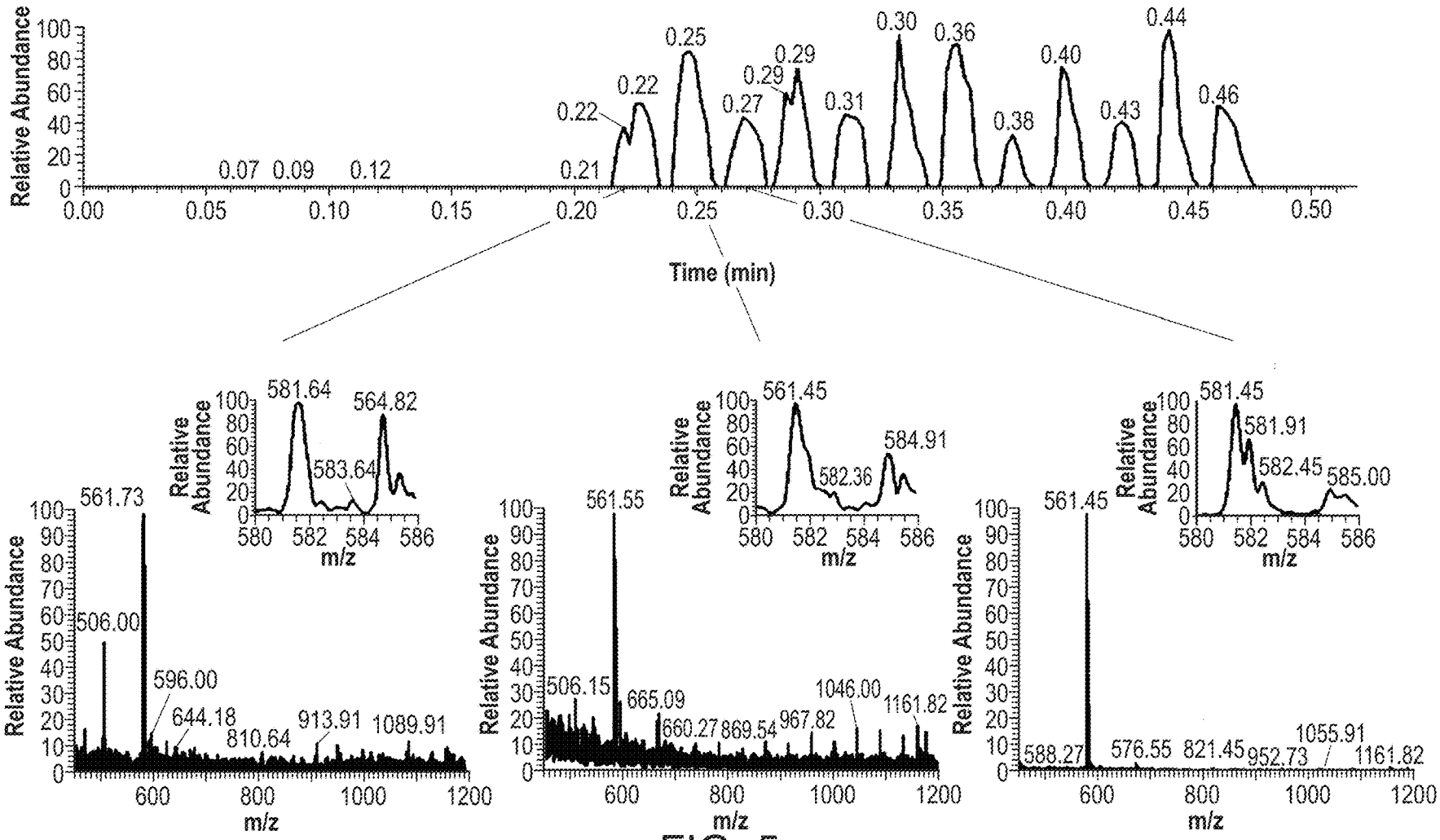
FIG. 5 shows results of combining induced electrophoretic cleaning with the multiplexed system. Top: total ions chronogram of 12 samples. Bottom: mass spectrum of peak #1 to #3 in TIC. Prior electrophoretic cleaning of the samples was done followed by induced DC nESI analysis.

FIG. 5 shows results of combining induced electrophoretic cleaning with the multiplexed system. Samples experience 10 seconds of off-line electrophoretic cleaning as described herein, followed by induced DC nESI bioassays analysis. From the TIC, the analysis time is also 1.4 seconds per sample and the peak width of each sample is ca. 1 second. From the mass spectra of peak #1 to #3 in TIC, we found that the cluster peaks arising from the complex matrix disappear and the SNR of the target peptide is increased. This indicates that the sample was cleaned by the electrophoresis induced by the high voltage electrical field. The signal intensity ratio of the target peptide to internal standard for peaks #1 to #3 is 1:1, 2:1 and 4:1, which are consistent with the ratio we spiked in the samples. No carryover is observed. As the cleaning step does not change the ratio of target molecule and internal standard, the cleaning step can be used to improve the performance in quantitative analysis.

Example 2: Quantitative Analysis of BACE1 Bioassays

Figure 6:
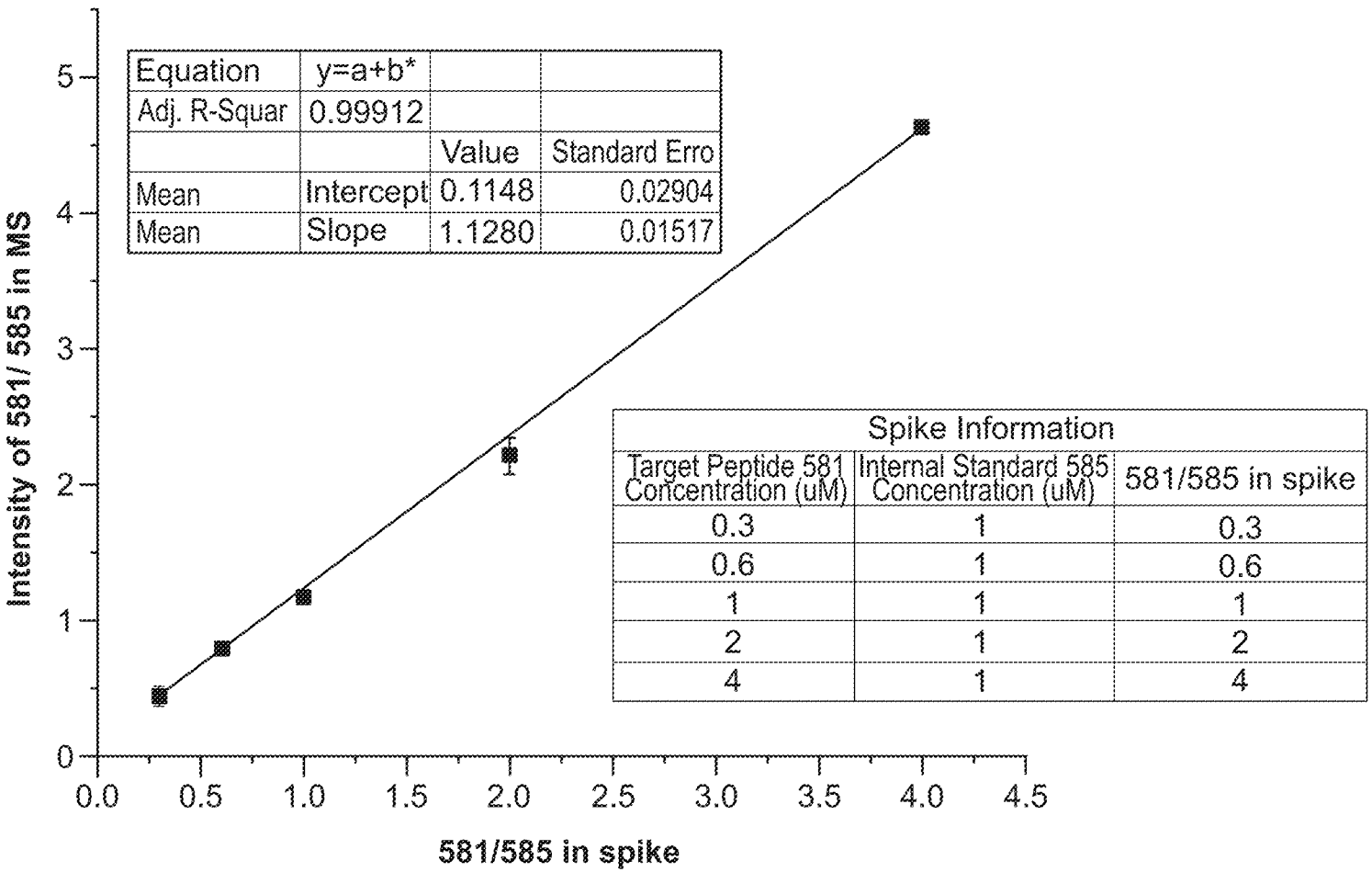
FIG. 6 shows a calibration curve of 300 nM to 4 μM target peptides with 1 μM internal standard in BACE1 buffer system.

The multiplexed system can be used for quantitative analysis of BACE1 bioassays, allowing the rapid evaluation of drugs and determination of $K_m$. We have made several samples with different concentrations of the target peptide (KTEEISEVNL, m/z=581.5) spiked. The internal standard (KTEEISEVN[L-13C6]-OH, m/z=585.0) concentration is fixed at 1 μM. These samples experienced 10 seconds electrophoretic cleaning followed by induced DC nESI analysis. FIG. 6 shows a calibration curve of signal intensity ratio of 581.5 to 585.0 in MS vs. the concentration ratio of target peptide and internal standard in the sample solutions. The error bar is measure in triplicate analysis. The $R^2$ is 0.9991 for the fitted linear curve. This result proves the capability of this system for quantitative bioassays analysis.

Figure 7:
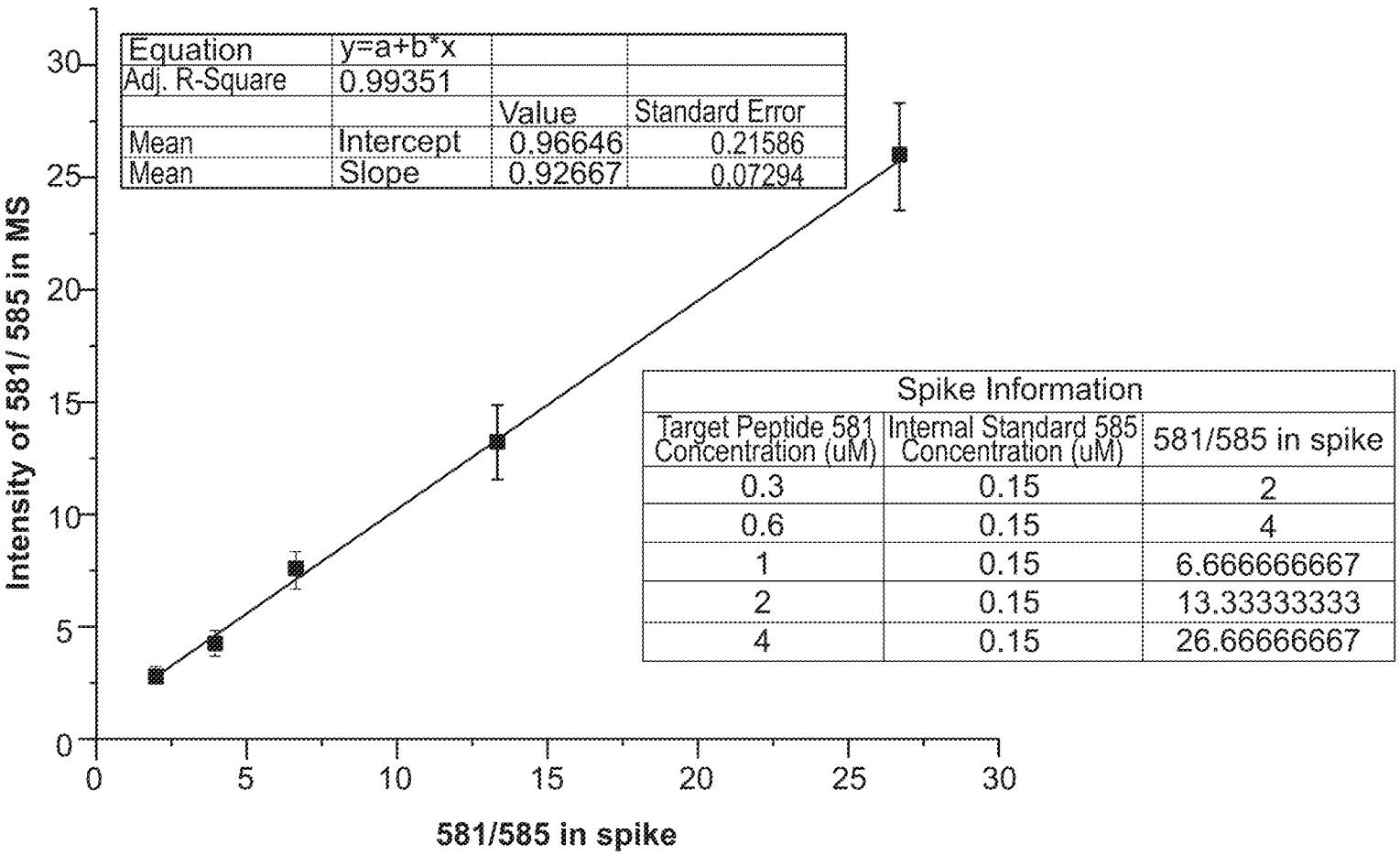
FIG. 7 shows a calibration curve of 300 nM to 4 μM target peptides with 150 nM internal standard in BACE1 buffer system.

We have further reduced the internal standard concentration from 1 μM to 150 nM to test the sensitivity of this system. As shown in FIG. 7, $R^2$ of the calibration curve is 0.9935. One typical mass spectrum of 150 nM internal standard and 300 nM target peptide after cleaning is shown in FIG. 5 and the SNR of target peptide (300 nM) is greater than 10 and SNR of internal standard (150 nM) is greater than 5. Therefore, the LOQ of target peptide using this system with electrophoretic cleaning for peptide screening from BACE1 system is 300 nM. The dynamic range is 300 nM to 4 μM, which is capable for screening drug activities and $K_m$ determination.

Figure 8:
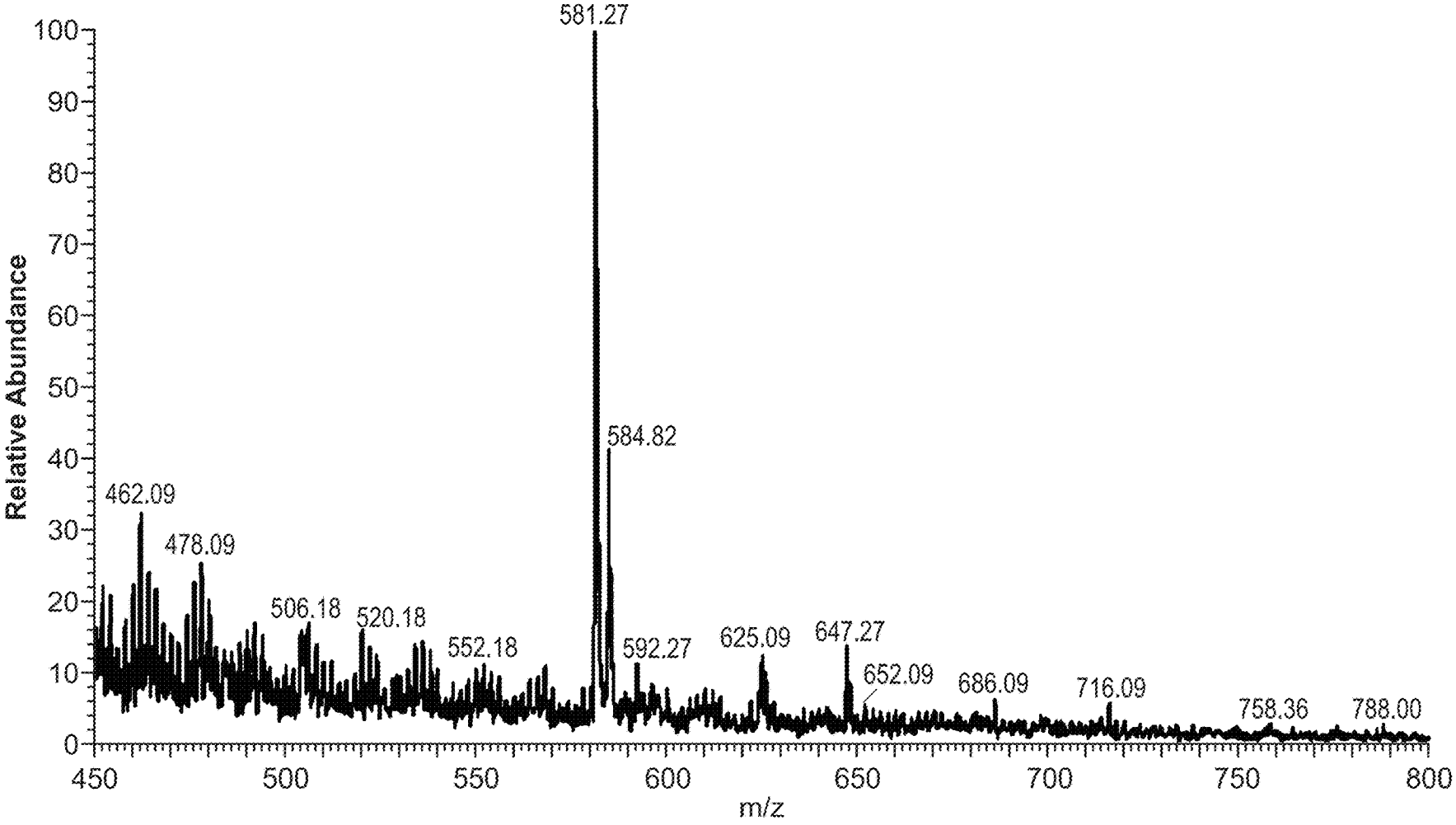
FIG. 8 shows a typical mass spectrum of 150 nM internal standard and 300 nM target peptide after electrophoretic cleaning.

FIG. 8 shows a typical mass spectrum of 150 nM internal standard and 300 nM target peptide after electrophoretic cleaning.

Example 3: High-Throughput Bioassays Using "Dip-and-Go" Multiplexed Electrospray Mass Spectrometry A multiplexed system based on inductive nanoelectrospray mass spectrometry (nESI-MS) has been developed for high-throughput screening (HTS) bioassays. This system combines inductive nESI and field amplification microelectrophoresis to achieve a "dip-and-go" sample loading and purification strategy that enables nESI-MS based HTS assays in 96-well microtiter plates. The combination of inductive nESI and micro-electrophoresis makes it possible to perform efficient in situ separations and clean-up of biological samples. The sensitivity of the system is such that quantitative analysis of peptides from 1-10 000 nm can be performed in a biological matrix. A prototype of the automation system has been developed to handle 12 samples (one row of a microtiter plate) at a time. The sample loading and electrophoretic cleanup of bio-samples can be done in parallel within 20 s followed by MS analysis at a rate of 1.3 to 3.5 s per sample. The system was used successfully for the quantitative analysis of BACE1-catalyzed peptide hydrolysis, a prototypical HTS assay of relevance to drug discovery. IC 50 values for this system were in agreement with LC-MS but recorded in times more than an order of magnitude shorter.

Figure 11:
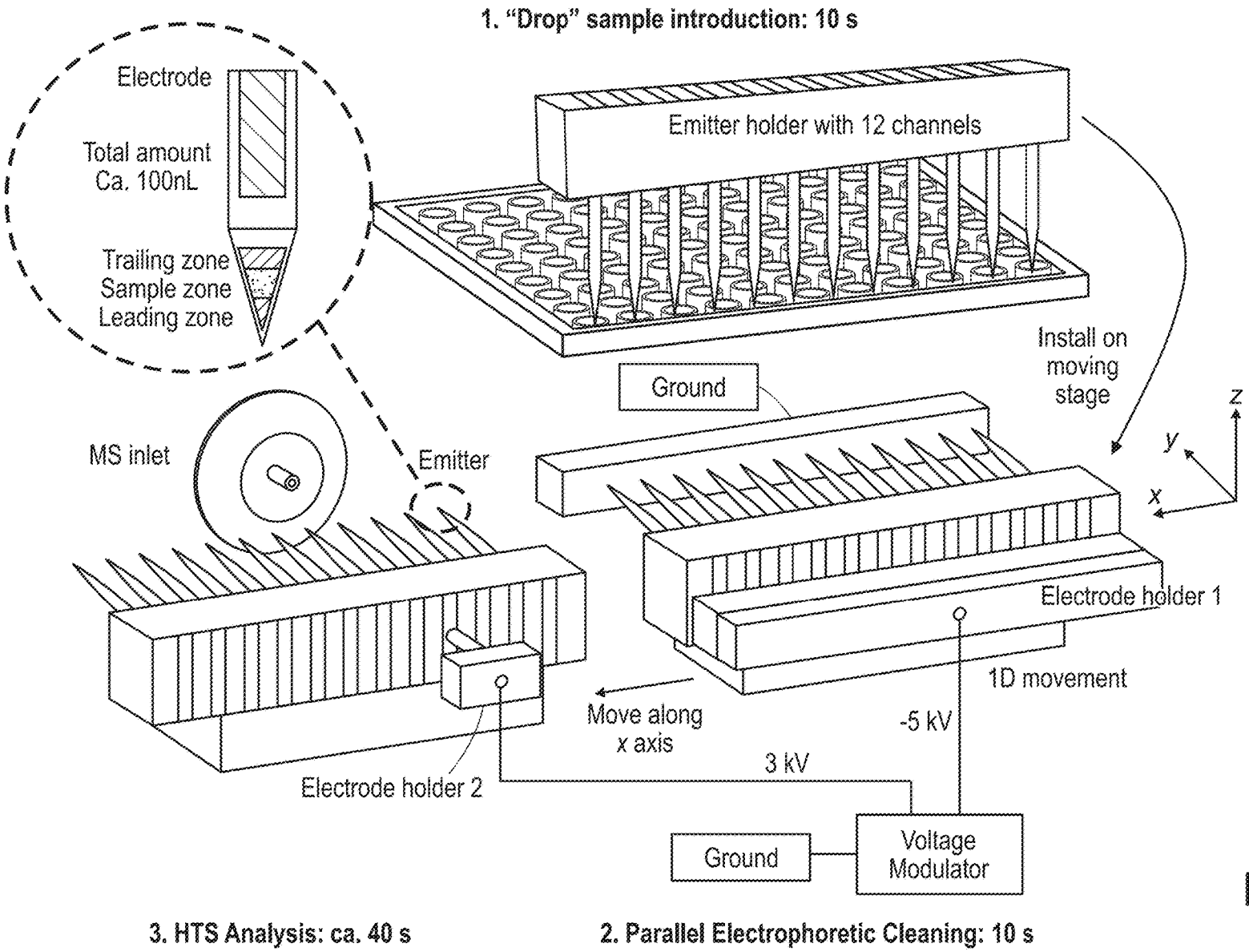
FIG. 11 shows instrumentation for dip-and-go multiplexed HTS bioassay. The emitter holder has 12 channels which can hold 12 emitters designed to fit the 96-well plate format. Step 1 is the "dip" step used for sample introduction. The emitters are immersed into water, sample solution and water in turn (the Figure only shows dip into sample solution) to load the leading and trailing zones with pure water and the mid zone with sample solution. In step 2 the holder is installed on a 1D moving stage and subjected to 10 s electrophoretic cleaning. In step 3, the emitters are moved into position for inductive nESI-MS analysis.

Herein, we establish the performance of a dip-and-go multiplex system (FIG. 11) for HTS bioassays based on a combination of inductive nESI with field amplified micro-electrophoretic cleaning. Inductive nESI enables the "dip" method of sample introduction for samples of approximately 100 nL volume from a96-well microtiter plate. The samples are introduced into the emitters by simply immersing the emitter tips into the sample solution, significantly decreasing the time compared to traditional nESI techniques. To fit the format of a96-well microtiter plate, a 3D printed emitter holder was used for simultaneous introduction of samples from one row of the microtiter plate. We used a DC electrical field to initiate inductive nESI and to perform micro-electrophoresis by simply modulating the electrical field strength.

During the "dip" event we load three separate bands of solutions with different electrical conductivity into the emitter. This allows field amplification, a method that can dramatically increase the performance of micro-electrophoresis. The high-performance cleaning process takes just 10 s and is applied to the emitters in parallel, resulting in a significantly improved and rapid sample clean-up process. Subsequently, the emitters are subjected to inductive nESI analysis. The emitter holder is moved in front of the mass spectrometer to allow screening at a rate of 1.3-3.5 s/sample. The total analysis time of one row of a96-well microtiter plate is ca. 2 min, comprised of ca. 10 s for sample loading, 10 s for field amplification micro-electrophoretic cleaning, ca. 40 s for inductive nESI analysis and 50 s for homing the device for measurement of the next row. In order to evaluate the performance of our multiplexed nESI system for application to HTS bioassays we selected BACE1 as a prototypical enzyme of relevance for HTS since it has been successfully screened by mass spectrometry in the past.

Figure 12:
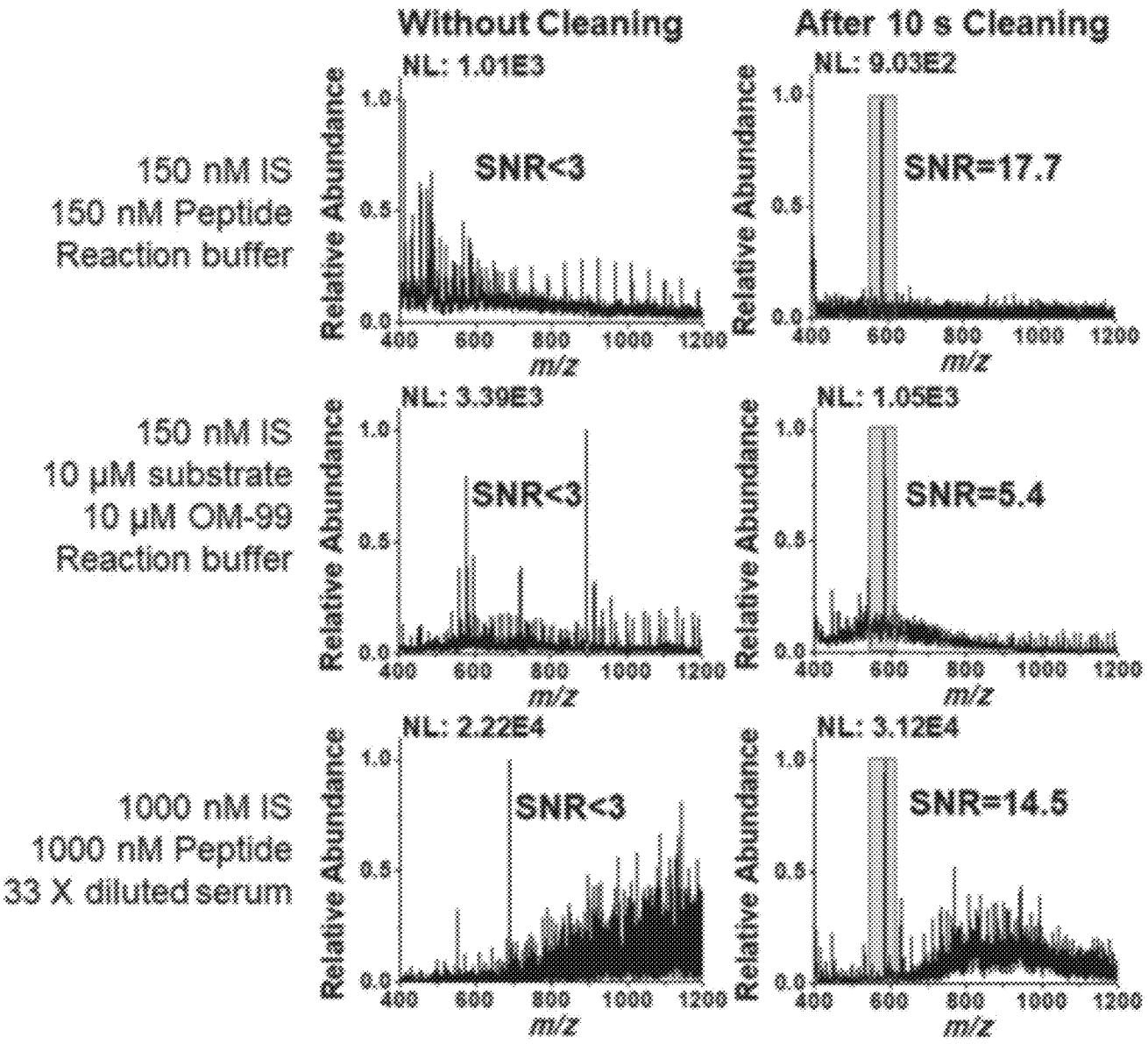
FIG. 12 shows full scan mass spectra using inductive nESI analysis of KTEEISEVNL (SEQ ID NO.: 1) (m/z 581.5) with internal standard KTEEISEVN(L-13C7) (m/z 585.0) in different biological matrices with and without field amplification micro-electrophoretic clean-up. Reaction buffer is 2 nm BACE1 enzyme, 6 mm sodium acetate, 1.5% glycerol, 0.25% DMSO, 3 ppm Brij-27 and 1% formic acid.

For the bioassays, we examined the analytical performance of inductive nESI with field amplification micro-electrophoresis. FIG. 12 compares analysis of the reaction product peptide here designated as KTEEISEVNL and its isotopically labeled internal standard (IS) KTEEISEVN(L-13C7) (stoichiometry is 1:1) in different biological matrices using full m/z scan mass spectra. Spectra obtained without electrophoretic cleaning (left column) show strong ion suppression effects leading to signal to noise ratios (SNR) below 3. This is inadequate even for qualitative analysis. The spectra obtained after 10 s of electrophoretic clean-up (right column) by contrast show SNR of 17.7 and 5.4 in the reaction buffer and in buffer with interfering peptides, respectively. After clean-up, the ratio of KTEEISEVNL and IS remains 1:1 as expected, demonstrating the precision of the technique. An LoQ of 150 nm was obtained for the KTEEISEVNL using full scan MS at SNR>10. Plots of the calibration curve acquired by full scan MS after clean-up MS demonstrate a linear dynamic range from 150 nm to 4000 nm (R2=0.9950). The results of analyzing 1000 nm KTEEISEVNL in diluted human serum are also encouraging. As shown in full scan spectra, electrophoretic clean-up of human serum sample shows SNR of 14.5 for the target peptide while the peptide peaks are submerged under baseline without cleaning. Ion isolation followed by amass scan increased the SNR from below 3 to 20-40 and also increased the signal intensity 13.2 to 130-fold. We also interrogated precision and carryover in high-throughput bioassays. Briefly, the relative standard deviation was less than 15% at a scan rate of 2 to 4 s/sample. The carryover between two measurements using the same emitter was less than 2.5%. The above results demonstrate the power of the dip-and-go multiplexed system in bioassays.

Figure 13:
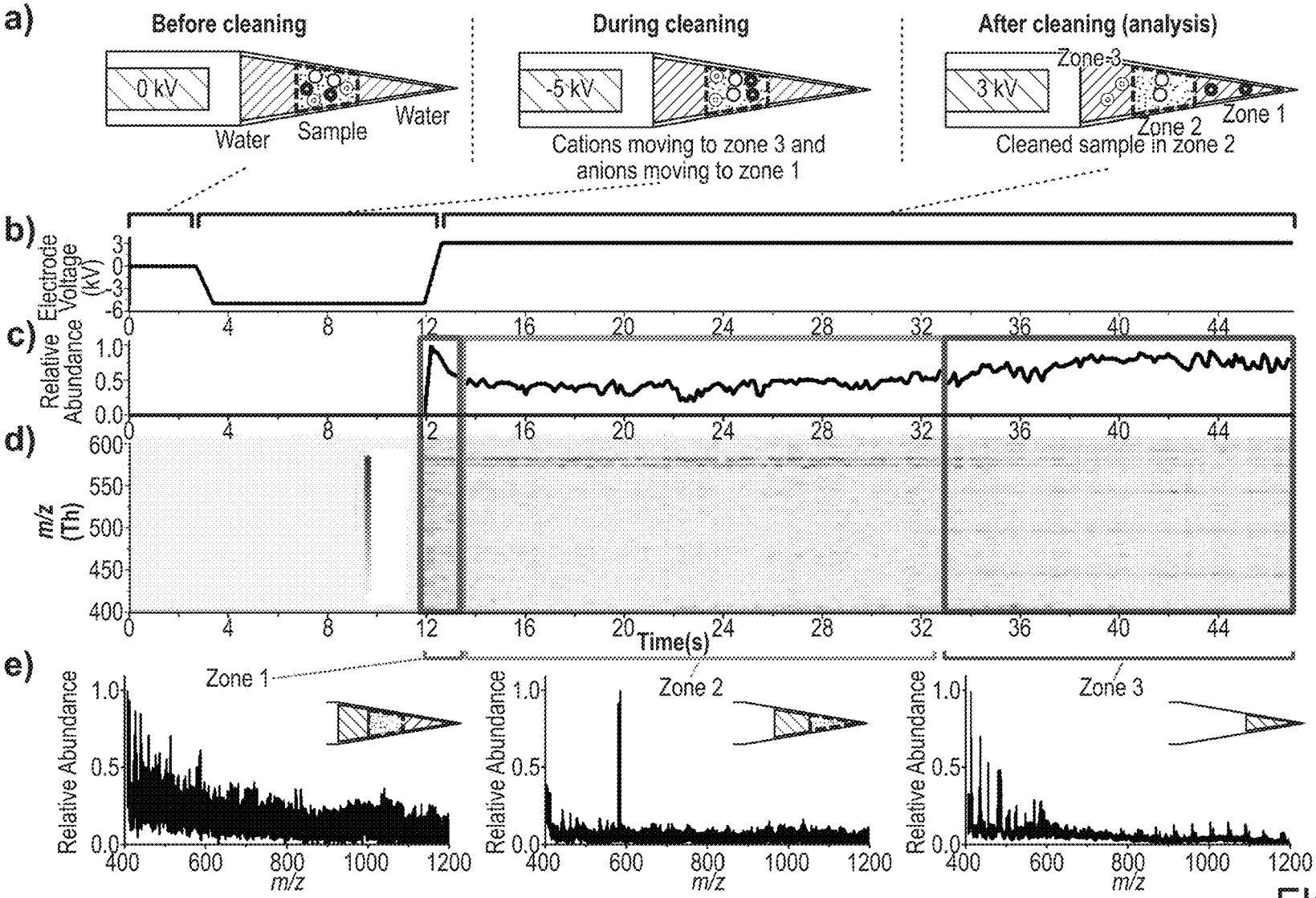
FIG. 13 panels A-E show a process of field amplification micro-electrophoresis. Panel A) Ion migration in each step (note that electro-neutrality will be maintained over the whole solution volume including zones 1, 2 and 3 while each individual zone can have a net charge). Panel B) Electrode voltage vs. time in the process. Panel C) TIC over course of the process. Panel D) Ion map of the process. Panel E) Typical mass spectra from the three zones.

FIG. 13 panels A-E show the operating mode of field amplification micro-electrophoresis. FIG. 13 panel A shows the formation of three distinct sample and solvent zones before electrophoresis: the highly conductive sample solution with its complex matrix (zone 2) and the surrounding low conductivity leading (zone 1) and trailing (zone 3) zones of pure water. Electrophoresis (on at 3 s, off at 12 s, FIG. 13 panel B) was performed by simply changing the electrode voltage from zero to @5 Kv and maintaining this value for ca. 10 s. After electrophoresis (12 s to 45 s, FIG. 13 panel B), the electrode voltage was changed to +3 kV for inductive nESI analysis. The total ion chronogram (TIC, FIG. 13 panel C) after cleaning is stable while the ion map shows multiple extracted ion chronograms (FIG. 13 panel D). Three typical zones appear after clean-up. Typical mass spectra (FIG. 13 panel E) of zone 1 are very noisy; the spectrum of zone 2 is very clean with the analyte peptides displaying very high SNR and enhanced signal intensity, while the spectrum of zone 3 shows matrix peaks. These results are consistent with the following proposed mechanism: during electrophoresis (@5 kV voltage applied to the electrode) a strong static electrical field in the solution pulls small cations and positively charged complexes into zone 3 (they show up later as the interference peaks in the MS of zone 3); the initial negative potential also pushes small anions into zone 1 so cleaning the analyte in zone 2 of interfering negatively charged ions. By removal of the high mobility ions from zone 2, a commensurate narrowing of the bandwidth and pre-concentration of weak electrolytes (e.g. peptides) within zone 2 will occur to compensate for the decrease in conductivity. Since electrical field strength is inversely proportional to conductivity, an amplified electrical field is created inside zones land 3 which accelerates the separation. This special field amplification operating mode for micro-electrophoresis is quite different from traditional field amplification capillary zone electrophoresis, in which the sample zone has much lower conductivity than the surrounding buffer used for electrophoresis. Indeed, this operating mode is generally not achievable in traditional capillary zone electrophoresis because buffer solution with good conductivity is needed to control the Joule heating that limits performance in electrophoresis. In the micro-electrophoresis driven by the inductive static electrical field, the current is much lower. Since the sample volume introduced by our dip-and-go strategy is on the order of 100 nL, a low current generates sufficient electrophoretic separation without excessive Joule heating.

Figure 14:
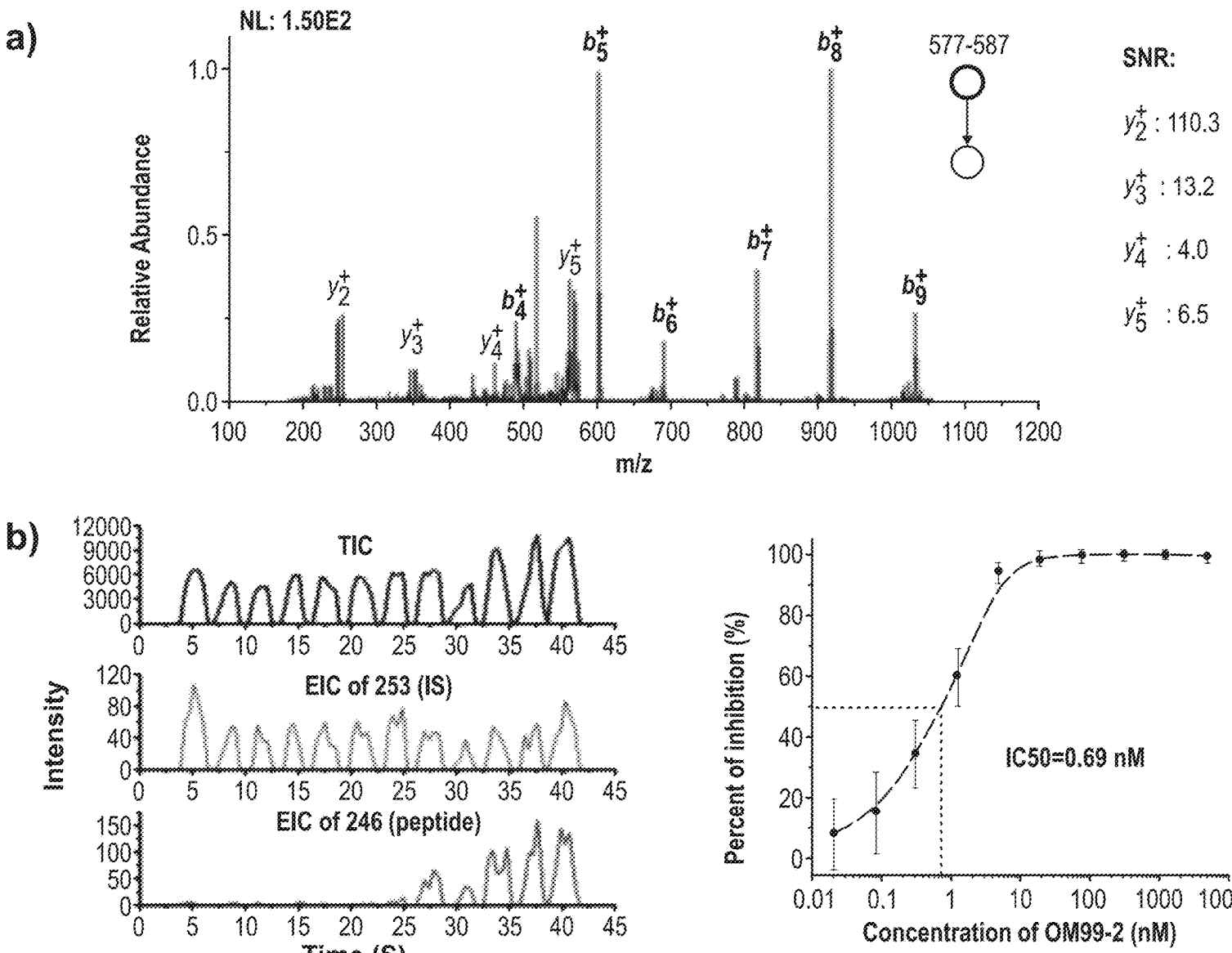
FIG. 14 panel A shows MS2 spectrum of precursor ions in range of m/z 578 to 588. The collision energy used is 30 (nominal value). This range covers the doubly charged precursor ions of KTEEISEVNL (m/z 581.5) and IS (m/z 585.0). The spiked ratio of the KTEEISEVNL and IS is 1:1.

As an example of a prototypical HTS application, we used our dip-and-go multiplexed system to determine the IC50 of the well-characterized BACE1 inhibitor OM99-2 by following BACE1 catalyzed hydrolysis of KTEEISEVNLDAEFRHDK to KTEEISEVNL. We spiked 150 nm KTEEISEVN(L-13C7) into the final assay as internal standard. Since the concentration of the peptide product can be very low in highly inhibited reactions, we used the MS/MS scan mode for quantification and determination of IC50. As shown in FIG. 14 panel A, for an artificial solution with 1:1 ratio of KTEEISEVNL:IS, we isolated ions from m/z 578 to 588 and fragmented them before recording product ion spectra. Two pairs of product ions showing a 1:1 intensity ratio for the 7 Da (singly charged) mass difference appear: the pair of m/z 246.2 and 253.2 and the pair of m/z 561.3 and 568.3. As the ion pair m/z 246.2 and 253.2 shows a very low baseline and the very high SNR of 110, this pair was used for quantification. Twelve samples were prepared spanning 5-orders of magnitude range of OM99-2 concentrations in order to determine the IC50 against BACE1. These samples were placed in 7 rows (7 replicates, 84 samples in total) of a microtiter plate and analyzed by dip-and-go analysis. FIG. 14 panel B shows a typical TIC as well as EIC for the IS and target peptide from analysis of one row of samples at a scan rate of 3.5 s/sample. From left to right the inhibition is 100% to 0. These seven measurements were normalized to plot the IC50 curve shown in FIG. 14 panel C.

The IC50 curve determined by our dip-and-go multiplexed system is consistent with that determined by an LC-MS experiment performed specifically to allow this comparison. The total measurement time of these 84 samples by the dip-and-go method was only ca. 14 min while that for LC-MS was 11 hours (8 min/sample).

In summary, we have developed a dip-and-go multiplexed system that is suitable for HTS bioassays. This system uses a novel "dip" sample loading strategy which can be combined with inductive nESI to achieve HTS nESI analysis for the first time. We have developed a new operating mode for field amplification micro-electrophoresis in which small volumes of reaction solution are (i) purified in situ and (ii) pre-concentrated. This method enables accelerated sample clean-up and ultra-high sensitivity HTS bioassays. The screening rate of the system herein is 1.3-3.5 s/sample and the total analysis time for 96 samples is ca. 16 min, representing a significant improvement over the throughput of conventional LC-MS (several min per sample) and competitive with typical "catch and elute" SPEMS systems used for current HTS bioassays such as the Rapid Fire platform (ca. 8 s/sample). With the aid of high resolution MS, the performance of the "dip-and-go" system can be further improved. The current multiplexed system is quite efficient for the analysis of compounds with low electrical mobility, for example, oligosaccharides and peptides, because they can be pre-concentrated in the mid zone and separated from matrix components; the clean-up for small metabolites is still challenging since they may move together with the salts.

What is claimed is:

1. An online cleaning method comprising:

providing an ionization system comprising: a substrate comprising a plurality of openings, each sized to receive a hollow elongate member that comprises a sample; an electrode within each of the plurality of openings, the electrode being configured to extend into the elongate member and terminate prior to the sample in the elongate member, wherein a rear of the electrode extends external to a back of each of the plurality of openings; a first voltage source configured to operably interact with the electrode; and a second voltage source, wherein the first voltage source is aligned with an inlet of a mass spectrometer and the second voltage source is not aligned with the inlet of a mass spectrometer; and operating the system such that the second voltage source is used for electrophoresis to separate in the sample a target analyte from at least one salt and the first voltage source is used for inductive ionization of the target analyte that has been separated from the at least one salt via an applied Direct Current (DC) potential.

2. The method of claim 1, wherein the sample is loaded into each of the plurality of the elongated members and the then the plurality of the elongate members are loaded onto the system.

3. The method of claim 1, wherein the plurality of the elongate members are loaded onto the system and then the sample is loaded into each of the plurality of the elongated members.

4. The method of claim 2, wherein the plurality of the elongate members are simultaneously dipped into different vessels, each vessel comprising a different sample.

5. The method of claim 4, wherein prior to ionization, a voltage is applied to the sample in a manner that cause electrophoresis to occur within the sample, thereby separating in the sample the target analyte and at least one salt, which become differentially ionized.

6. The method of claim 5, wherein the electrophoresis and the ionization occur with a single electrode.

7. The method of claim 5, wherein the electrophoresis and the ionization occur with a plurality of different electrodes.

* * * * *